US008543042B2

(12) United States Patent
Tanaka et al.

(10) Patent No.: US 8,543,042 B2
(45) Date of Patent: Sep. 24, 2013

(54) IMAGE FORMING APPARATUS AND IMAGE FORMING METHOD

(75) Inventors: Shinichi Tanaka, Shiojiri (JP); Satoshi Chiba, Suwa (JP); Koichi Kamijo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 785 days.

(21) Appl. No.: 12/722,850

(22) Filed: Mar. 12, 2010

(65) Prior Publication Data

US 2010/0247172 A1 Sep. 30, 2010

(30) Foreign Application Priority Data

Mar. 25, 2009 (JP) ..... 2009-073913

(51) Int. Cl.
*G03G 15/01* (2006.01)

(52) U.S. Cl.
USPC ..... 399/302; 399/303

(58) Field of Classification Search
USPC ..... 399/302–304
See application file for complete search history.

(56) References Cited

U.S. PATENT DOCUMENTS

| | | | | |
|---|---|---|---|---|
| 5,016,056 | A | 5/1991 | Johnson et al. | |
| 6,389,242 | B1 | 5/2002 | Watanabe | |
| 8,254,817 | B2 * | 8/2012 | Kamijo et al. | 399/303 |

FOREIGN PATENT DOCUMENTS

| | | |
|---|---|---|
| JP | 04-507308 | 12/1992 |
| JP | 06-274048 | 9/1994 |
| JP | 2002-156839 | 5/2002 |
| JP | 2008-096715 | 4/2008 |

* cited by examiner

*Primary Examiner* — David Gray
*Assistant Examiner* — Erika J Villaluna
(74) *Attorney, Agent, or Firm* — Workman Nydegger

(57) ABSTRACT

An image forming apparatus including a transfer belt on which an image is transferred, a belt suspension roller that suspends the transfer belt, a transfer roller that is arranged to face the belt suspension roller with the transfer belt in between and includes a shaft portion and a concave portion formed in a shaft direction, and a support member that is arranged on the shaft portion of the transfer roller and includes a first circumferential portion arranged in the concave portion as seen from a shaft direction of the transfer roller, a second circumferential portion arranged at one side of the concave portion in a rotation direction, and a third circumferential portion arranged at the other side of the concave portion in the rotation direction.

8 Claims, 10 Drawing Sheets

IMAGE FORMING APPARATUS AND IMAGE FORMING METHOD

BACKGROUND OF THE INVENTION

The entire disclosure of Japanese Patent Application No. 2009-073913, filed Mar. 25, 2009 is expressly incorporated herein by reference.

1. Technical Field

The present invention relates to an image forming apparatus and an image forming method. More specifically, the present invention relates to an apparatus and method for forming an image by developing a latent image using a liquid developer including toner and carrier, transferring the developer onto a medium such as recording paper, fusing and fixing the toner image transferred onto the medium.

2. Related Art

Various wet-type image forming apparatuses are currently known in the art which develop a latent image to form a electrostatic latent image using a high viscosity liquid developer using a toner comprising solid particles distributed in a liquid solvent. The developer used in the wet-type image forming apparatus obtained by suspending solid particles or toner particles in a high viscosity insulating organic solvent or carrier liquid comprising silicon oil, mineral oil, edible oil, and the like. The toner particles have a very small diameter of approximately 1 μm. Because such fine toner particles are used, the wet-type image forming apparatus can form an image having a higher quality than that of a dry-type image forming apparatus which uses powder toner particles having a particle diameter of about 7 μm. One example of a liquid developer currently known in the art is disclosed in Japanese Patent Document JP-A-2002-156839, which discloses an image forming apparatus including an image forming means for forming an electrostatic latent image on an image carrying member, a developing means for developing the electrostatic latent image on the image carrying member by using a developing solution in which developer particles are distributed in a solvent, an intermediate transfer medium which comes into contact with the image carrying member to transfer the visible image from the image carrying member, a backup member which comes into contact with the intermediate transfer medium, a transfer means for transferring the visible image from the intermediate transfer medium to a transferred body, a determining means for determining a type of the transferred body to which the visible image is transferred, a control means for variably controlling a pressing force against the transferred body by the backup member in accordance with the type of the transferred body determined by the determining means.

One problem with the image forming apparatus described in JP-A-2002-156839, however, is that the pressing means and backup member of the structure do not allow a concave portion to be provided in the backup member for housing a transfer material holding mechanism that holds the transfer material. More specifically, there is a problem that such a structure does not operate smoothly when the concave portion of backup member faces the intermediate transfer medium.

BRIEF SUMMARY OF THE INVENTION

A first aspect of the invention is an image forming apparatus according including a transfer belt on which an image is transferred, a belt suspension roller that suspends the transfer belt, a transfer roller that is arranged to face the belt suspension roller with the transfer belt in between and includes a shaft portion and a concave portion formed in a shaft direction, and a support member that is arranged on the shaft portion of the transfer roller. The support member includes a first circumferential portion arranged in the concave portion of the transfer roller as seen from a shaft direction of the transfer roller, a second circumferential portion arranged at one side of the concave portion in a rotation direction of the transfer roller as seen from the shaft direction of the transfer roller, and a third circumferential portion arranged at the other side of the concave portion from the one side in the rotation direction of the transfer roller as seen from the shaft direction of the transfer roller.

An image forming method according to a second aspect of the invention includes carrying an image on a transfer belt suspended by a belt suspension roller, transferring the image to a transfer material by passing the transfer material through a transfer nipping area formed by causing a transfer roller having a concave portion formed in a shaft direction to come into contact with the belt suspension roller with the transfer belt in between, transferring the image to the transfer material, and thereafter causing a support member that is arranged on a shaft portion of the transfer roller and includes a first circumferential portion arranged in the concave portion of the transfer roller as seen from a shaft direction of the transfer roller, a second circumferential portion arranged at one side of the concave portion in a rotation direction of the transfer roller as seen from the shaft direction of the transfer roller, and a third circumferential portion arranged at the other side of the concave portion from the one side in the rotation direction of the transfer roller as seen from the shaft direction of the transfer roller to come into contact with a second support member arranged at a shaft end portion of the belt suspension roller.

According to the image forming apparatus and the image forming method of an aspect of the invention, although the transfer roller is urged to the belt suspension roller, there is a contact member on the shaft portion of the transfer roller and a contacted member on the shaft portion of the belt suspension roller, so that, when the concave portion is not in contact with the transfer belt, the transfer roller can apply a predetermined pressure to the transfer nip, and when the concave portion faces the transfer belt, a positional relationship between the transfer roller and the belt suspension roller can be maintained.

According to the image forming apparatus and the image forming method of an aspect of the invention, even when the transfer roller having the concave portion is used, it is possible to seamlessly move between a constant load state in which a certain amount of pressure is applied to the transfer nip and a constant positional state in which the positional relationship between the transfer roller and the belt suspension roller is constant without generating vibration or the like. As such, there are no adverse effects in the image forming process and image quality deterioration can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
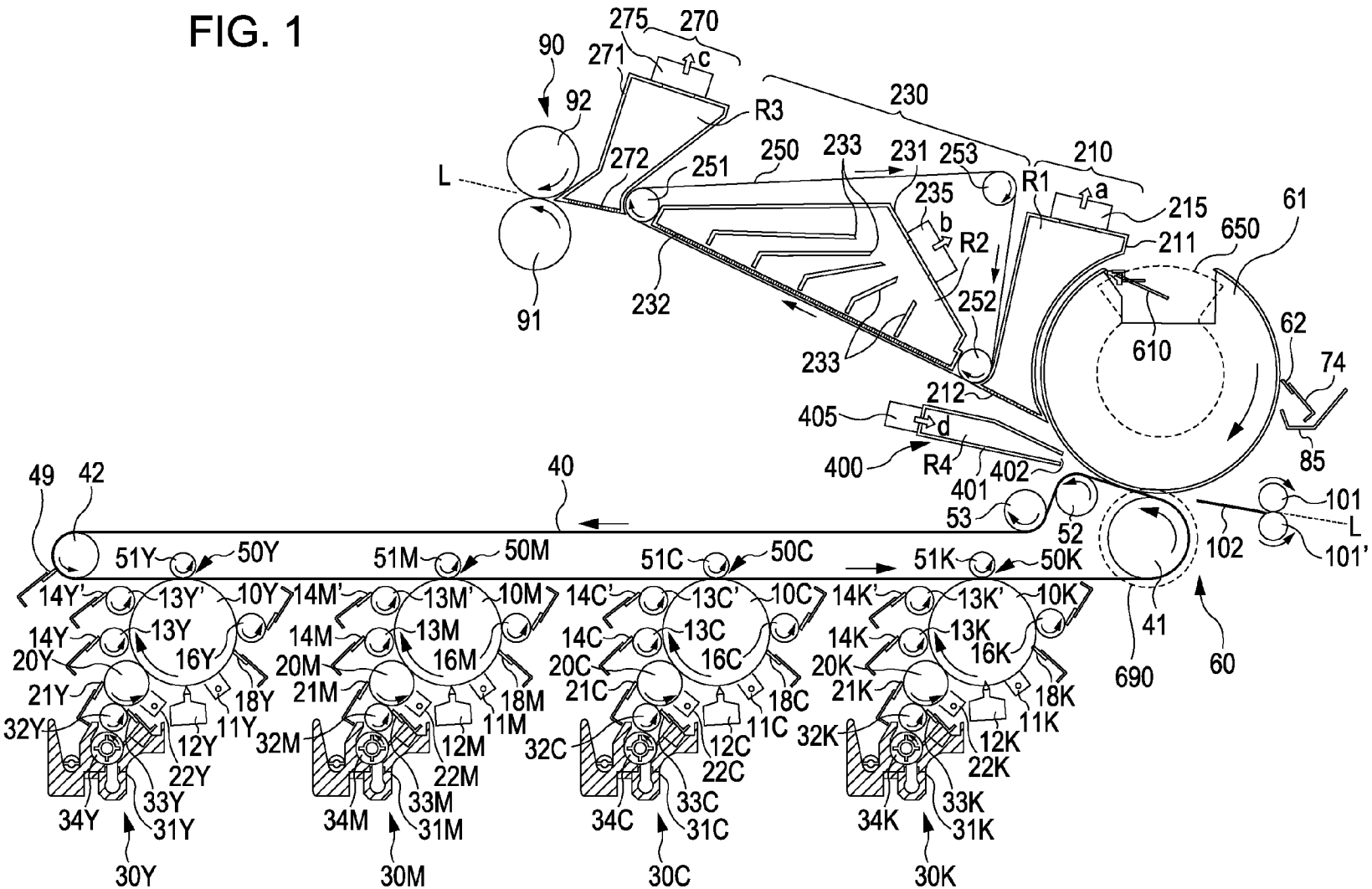
FIG. 1 is a diagram showing main constituent elements constituting an image forming apparatus according to an embodiment of the invention.

Hereinafter, an embodiment of the invention will be described with reference to the drawings. FIG. 1 is a diagram showing the main constituent elements constituting an image forming apparatus according to the embodiment of the invention. Each color section of the image forming sections are arranged in the center of the image forming apparatus. The developing devices 30Y, 30M, 30C, and 30K are arranged in a lower part of the image forming apparatus, and components such as a transfer belt 40, a secondary transfer section or secondary transfer unit 60, a fixing unit 90, and the like are arranged in an upper part of the image forming apparatus.

More particularly, the fixing unit 90 is laid out above the transfer belt 40, so that it is possible to reduce the footprint of the entire image forming apparatus. Such a layout can be realized because the embodiment has a configuration in which a transfer material, such as paper, which is passed through a secondary transfer process in the secondary transfer unit 60 is then sucked by a transfer material transportation device 230, suction devices 210 and 270, and the like, and then transported to the fixing unit 90.

The developing devices 30Y, 30M, 30C, and 30K include photoreceptors 10Y, 10M, 10C, and 10K, corona charging devices 11Y, 11M, 11C, and 11K, exposure units such as LED arrays 12Y, 12M, 12C, and 12K, and the like for forming an image of toner. The photoreceptors 10Y, 10M, 10C, and 10K are uniformly charged by the corona charging devices 11Y, 11M, 11C, and 11K, while exposures are performed by the exposure units 12Y, 12M, 12C, and 12K on the basis of an inputted image signal, and latent images are formed on the charged photoreceptors 10Y, 10M, 10C, and 10K.

The developing devices 30Y, 30M, 30C, and 30K approximately includes developing rollers 20Y, 20M, 20C, and 20K, developer containers or reservoirs 31Y, 31M, 31C, and 31K containing a liquid developer of each color of yellow (Y), magenta (M), cyan (C), and black (K), and anilox rollers 32Y, 32M, 32C, and 32K which are coating rollers for coating the developing rollers 20Y, 20M, 20C, and 20K with the liquid developers of each color from the developer containers 31Y, 31M, 31C, and 31K, which develop electrostatic latent images formed on the photoreceptors 10Y, 10M, 10C, and 10K.

The transfer belt 40 is an endless belt which is suspended by a drive roller 41 and tension rollers 42, 52, and 53, and is driven to rotate by the drive roller 41 while being in contact with the photoreceptors 10Y, 10M, 10C, and 10K in a primary transfer sections 50Y, 50M, 50C, and 50K. In the primary transfer sections 50Y, 50M, 50C, and 50K, the photoreceptors 10Y, 10M, 10C, and 10K and primary transfer rollers 51Y, 51M, 51C, and 51K are arranged to face each other with the transfer belt 40 in-between. Toner images of each color on the developed photoreceptors 10Y, 10M, 10C, and 10K are sequentially transferred to overlap on the transfer belt 40 by using contact positions between the photoreceptors 10Y, 10M, 10C, and 10K and the transfer belt 40 as transfer positions, so that a full color toner image is formed.

In the secondary transfer unit 60, a secondary transfer roller 61 is arranged so as to face the belt drive roller 41 with the transfer belt 40 being disposed in-between the secondary transfer roller 61 and the belt drive roller 41. A cleaning device including a secondary transfer roller cleaning blade 62 is also arranged in the secondary transfer unit 60. At the transfer position where the secondary transfer roller 61 is arranged, a single color toner image or a full color toner image formed on the transfer belt 40 is transferred onto a transfer material such as paper, film, cloth, and the like transported through a transfer material transportation path L.

Further downstream in the transfer material transportation path L, an air blower 400 is disposed for blowing air to a space between the transfer belt 40 and the secondary transfer roller 61, along with the first suction device 210, the transfer material transportation device 230, and the second suction device 270, which are arranged in this order, and which cause the transfer material to be transported to the fixing unit 90. In the fixing unit 90, the single color toner image or the full color toner image transferred onto the transfer material is fused and fixed onto the transfer material.

The tension roller 42, the belt drive roller 41, and the like suspend the transfer belt 40. A cleaning device including a transfer roller cleaning blade 49 is arranged so as to be in contact with the transfer belt 40 at a position where the transfer belt 40 is suspended by the tension roller 42. The cleaning device cleans residual toner and carrier on the transfer belt 40. The tension roller 42 may have a driving force to drive the transfer belt 40, and the belt drive roller 41 may be used as a mere belt suspension roller.

A paper feeder (not shown in FIG. 1) supplies the transfer material to the image forming apparatus. The transfer materials set in the paper feeder are fed into the transfer material transportation path L one by one at a predetermined timing. In the transfer material transportation path L, the transfer material is transported to the secondary transfer position by gate rollers 101, 101' and a transfer material guide 102, and the single color developed toner image or the full color developed toner image formed on the transfer belt 40 is transferred onto the transfer material.

As described above, the transfer material on which the toner image is secondary transferred is further transported to the fixing unit 90 by a transfer material transportation means based on the transfer material transportation device 230 and the like. The fixing unit 90 includes a heating roller 91 and a pressure roller 92 urged against the heating roller by a predetermined pressure. The transfer material is passed through a nipping point between the heating roller 91 and the pressure roller 92, so that the single color toner image or the full color toner image previously transferred onto the transfer material is fused and fixed to the transfer material such as paper.

Here, the developing devices will be described in more detail. Since the configurations of image forming sections and developing devices of each color are the same, hereinafter, the description is based on the image forming section and the developing device of yellow (Y).

In the image forming section, a photoreceptor cleaning roller 16Y, a photoreceptor cleaning blade 18Y, a corona charging device 11Y, an exposure unit 12Y, a developing roller 20Y of the developing device 30Y, a first photoreceptor squeeze roller 13Y, and a second photoreceptor squeeze roller 13Y' are arranged along the rotation direction of the outer circumference of the photoreceptor 10Y.

The photoreceptor cleaning roller 16Y comes into contact with the photoreceptor 10Y and rotates counterclockwise, so that the photoreceptor cleaning roller 16Y cleans any residual liquid developer remaining after the transfer process such that no liquid developer is transferred onto the photoreceptor 10Y. A bias voltage which attracts toner particles in the liquid developer is applied to the photoreceptor cleaning roller 16Y, so that the material collected by the photoreceptor cleaning roller 16Y is a solid-rich liquid developer including a large number of toner particles.

On the downstream side of the photoreceptor cleaning roller 16Y, the photoreceptor cleaning blade 18Y which is in contact with the photoreceptor 10Y cleans a carrier-rich liquid developer on the photoreceptor 10Y.

On the outer circumference of the developing roller 20Y in the developing device 30Y, a cleaning blade 21Y, an anilox roller 32Y, and a compaction corona generator 22Y are arranged. A regulating blade 33Y which adjusts an amount of liquid developer supplied to the developing roller 20Y is in contact with the anilox roller 32Y. An auger 34Y is accommodated in a liquid developer container 31Y. The primary transfer roller 51Y of the primary transfer section is arranged in a position so as to face the photoreceptor 10Y with the transfer belt 40 being disposed in-between.

The photoreceptor 10Y is a photoreceptor drum comprising a cylindrical member with a photosensitive layer such as an amorphous silicon photoreceptor formed on the outer circumference thereof, which rotates clockwise.

The corona charging device 11Y is arranged on the upstream side of the nipping point between the photoreceptor 10Y and the developing roller 20Y in the rotation direction of the photoreceptor 10Y. A voltage is applied from a power supply unit (not shown in FIG. 1) to the corona charging device 11Y to charge the photoreceptor 10Y. The exposure unit 12Y emits light onto the photoreceptor 10Y charged by the corona charging device 11Y on the downstream side of the corona charging device 11Y, and a latent image is formed on the photoreceptor 10Y. In the image forming process from the beginning to the ending, a roller or the like arranged in an earlier stage is defined to be more upstream than a roller or the like arranged in a later stage.

The developing device 30Y includes the compaction corona generator 22Y for performing a compaction operation and the developer container 31Y for containing a liquid developer in which a toner is distributed in a carrier at a weight ratio of approximately 20%.

The developing device 30Y includes the developing roller 20Y for carrying the liquid developer, the anilox roller 32Y which is a coating roller for coating the developing roller 20Y with the liquid developer, the regulating blade 33Y for regulating the amount of the liquid developer coating on the developing roller 20Y, the auger 34Y for agitating and transporting the liquid developer to supply the liquid developer to the anilox roller 32Y, the compaction corona generator 22Y for bringing the liquid developer carried on the developing roller 20Y into a compaction state, and the developing roller cleaning blade 21Y for cleaning the developing roller 20Y.

The liquid developer contained in the developer container 31Y is not a generally-used volatile liquid developer having low density (about 1 to 3 wt %), low viscosity, and volatility at room temperature and using Isopar (trademark: Exxon) as a carrier, but instead is a non-volatile liquid developer having high density, high viscosity, and non-volatility at room temperature. In other words, the liquid developer according to the embodiment of the invention is high-viscosity (viscoelasticity is about 30 to 300 mPa·s when a shear velocity is 1000 (1/s) at 25° C. by using HAAKE RheoStress RS600) liquid developer that is prepared by adding solid particles having average diameter of 1 μm, in which colorants (such as pigments) are dispersed in a thermoplastic resin, into a liquid solvent such as an organic solvent, silicon oil, mineral oil, or edible oil with a dispersant so as to have a toner solid content of about 25%.

The anilox roller 32Y functions as a coating roller for supplying the liquid developer to the developing roller 20Y and coating the developing roller 20Y with the liquid developer. The anilox roller 32Y is a cylindrical member and with a surface comprising concavities and convexities which are formed by a finely, uniformly, and spirally carved groove so that the developer is easily carried on the surface. The liquid developer is supplied from the developer container 31Y to the developing roller 20Y by the anilox roller 32Y. When the apparatus is in operation, as shown in FIG. 1, the auger 34Y rotates counterclockwise and supplies the liquid developer to the anilox roller 32Y, and the anilox roller 32Y rotates counterclockwise and coats the developing roller 20Y with the liquid developer.

The regulating blade 33Y is an elastic blade with an elastic material coated on its surface, and comprises a rubber material or the like including a urethane rubber which comes into contact with the surface of the anilox roller 32Y. The regulating blade 33Y regulates and adjusts the film thickness and amount of the liquid developer carried and transported by the anilox roller 32Y, and adjusts the amount of the liquid developer to be supplied to the developing roller 20Y.

The developing roller cleaning blade 21Y is constituted by a rubber material or the like which comes into contact with the surface of the developing roller 20Y. The developing roller cleaning blade 21Y is arranged downstream from a developing nipping area where the developing roller 20Y comes into contact with the photoreceptor 10Y in the rotation direction of the developing roller 20Y, so that the developing roller cleaning blade 21Y scrapes off and removes any residual liquid developer on the developing roller 20Y.

The compaction corona generator 22Y is an electric field application means for increasing the charge bias on the surface of the developing roller 20Y, and an electric field is applied from the compaction corona generator 22Y to the developing roller 20Y at a compaction position by the compaction corona generator 22Y. Alternatively, a compaction roller or the like may be used as the electric field application means for the compaction instead of the corona charging device shown in FIG. 1.

The developer which is carried by the developing roller 20Y and subsequently compacted is then developed in accordance with the latent image on the photoreceptor 10Y by applying a predetermined electric field to the developing nipping are where the developing roller 20Y comes into contact with the photoreceptor 10Y.

Any residual developer after the development process is then scraped off and removed by the developing roller cleaning blade 21Y, and dropped into a collection section in the developer container 31Y to be reused. The carrier and the toner reused in this way are not mixed with a carrier and a toner of any other color.

A photoreceptor squeeze device arranged upstream to the primary transfer section is arranged so as to face the photoreceptor 10Y downstream to the developing roller 20Y. The photoreceptor squeeze device collects redundant toner of the toner image developed on the photoreceptor 10Y. The photoreceptor squeeze device includes the first photoreceptor squeeze roller 13Y and the second photoreceptor squeeze roller 13Y' which comprise elastic roller members rotating in sliding contact with the photoreceptor 10Y, and which collect redundant carrier and unnecessary fogging toner from the toner image developed on the photoreceptor 10Y in order to increase the toner particle ratio in the visible toner image. A predetermined bias voltage is applied to the photoreceptor squeeze rollers 13Y and 13Y'.

The surface of the photoreceptor 10Y which has passed through the photoreceptor squeeze device including the first photoreceptor squeeze roller 13Y and the second photoreceptor squeeze roller 13Y' proceeds to the primary transfer section 50Y.

In the primary transfer section 50Y, the developer image developed on the photoreceptor 10Y is transferred onto the transfer belt 40 by the primary transfer roller 51Y. In the primary transfer section, the toner image on the photoreceptor 10Y is transferred onto the transfer belt 40 by an operation of the transfer bias applied to the primary transfer backup roller 51Y. Here, the photoreceptor 10Y and the transfer belt 40 move at the same speed, so that the driving load for rotation and movement is reduced and disturbance to the visible toner image on the photoreceptor 10Y is suppressed.

Toner images of magenta (M), cyan (C), and black (K) are respectively formed on the photoreceptors 10M, 10C, and 10K of the developing devices 30M, 30C, and 30K by the same process as that of the developing device 30Y. The transfer belt 40 passes through the nipping areas of the primary transfer sections 50 of yellow (Y), magenta (M), cyan (C), and black (K), and the developers (developed images) on the photoreceptors of each color are transferred and overlapped onto the transfer belt 40. Then the transfer belt 40 proceeds into the nip portion of the secondary transfer unit 60.

The transfer belt 40 which has passed through the secondary transfer unit 60 rotates so as to receive another set of images to be transferred in the primary transfer section 50, and the transfer belt 40 is cleaned on the upstream side of the primary transfer section 50 by the transfer belt cleaning blade 49 or the like.

The transfer belt 40 has a three-layer structure in which an elastic intermediate layer of polyurethane is provided on a polyimide base layer and a PFA surface layer is provided on the elastic intermediate layer. The transfer belt 40 is used such that the side of the polyimide base layer is suspended by the belt drive roller 41 and the tension rollers 42, 52, and 53, and the toner image is transferred onto the side of the PFA surface layer. As such, the transfer belt 40 has elasticity which is effective in sending and transferring toner particles having a small diameter onto concave portions of the transfer material in the secondary transfer process because the transfer belt 41 has good following capability and good adhesion to the surface of the transfer material.

Figure 2:
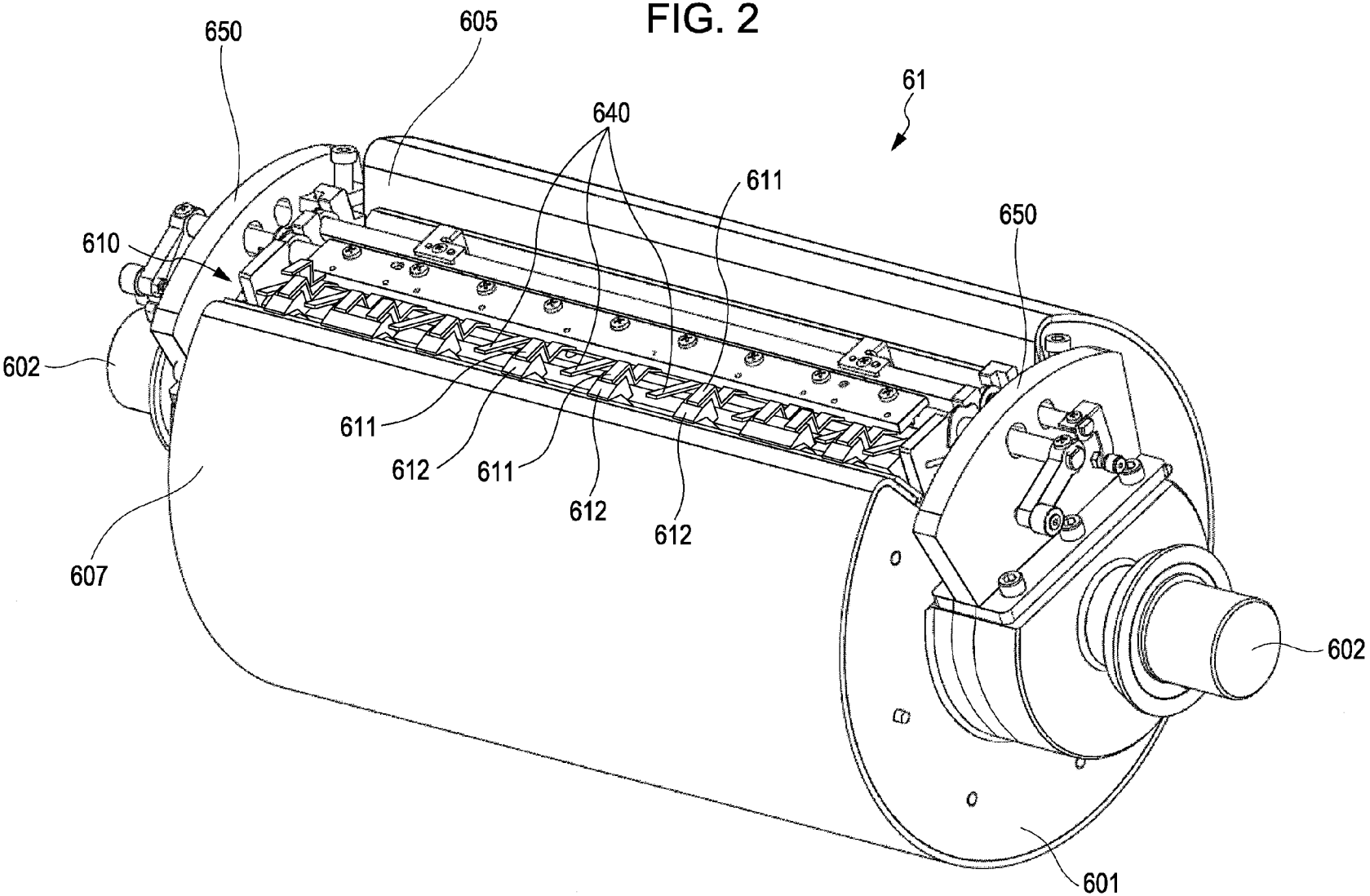
FIG. 2 is a perspective view of a secondary transfer roller used in the image forming apparatus according to the embodiment of the invention.

Next, the secondary transfer roller 61 used in the image forming apparatus according to the embodiment will be described in more detail. FIG. 2 is a perspective view of the secondary transfer roller used in the image forming apparatus according to the embodiment of the invention. As shown in FIG. 2, the secondary transfer roller comprises a roller body 601 portion, a roller shaft portion 602, a concave portion 605, an elastic member 607, a transfer material holding mechanism 610, a transfer material holding section 611, a transfer material holding section receiving section 612, a transfer material peeling section 640, and a contact member 650.

The roller shaft portion 602 is provided at both ends of the roller body portion 601 of the secondary transfer roller 61, and the secondary transfer roller 61 is mounted in the apparatus main body rotatably around the roller shaft portion 602. The concave portion 605 extending in the shaft direction is provided in the roller body portion 601. The transfer material holding mechanism 610 is provided in the concave portion 605, and the elastic member 607 is provided along the entire exterior of the roller body portion 601 except in the area where the concave portion 605 is formed. The transfer material holding mechanism 610 is a mechanism for holding and releasing the transfer material. The elastic member 607 comprises a semi-conductive rubber layer having an electrical resistance. When the transfer material is passed through the secondary transfer nipping area of the secondary transfer unit while the transfer material is wound around the elastic member 607, the toner image is transferred from the transfer belt 40 onto the transfer material.

The transfer material holding mechanism 610 is includes a plurality pairs of the transfer material holding section 611 and the transfer material holding section receiving section 612 which are discretely provided in the roller shaft direction and a plurality of the transfer material peeling sections 640 which are appropriately provided between the above pairs in the roller shaft direction. All the transfer material holding sections 611 are constituted to be movable. The transfer material holding sections 611 can hold the transfer material by holding the transfer member between the transfer material holding sections 611 and the transfer material holding section receiving sections 612, and then releasing the transfer material by widening a gap between the transfer material holding sections 611 and the transfer material holding section receiving sections 612. All the transfer material peeling sections 640 operate so as to push out the transfer member held by the transfer material holding sections 611 and the transfer material holding section receiving sections 612 in a direction away from the secondary transfer roller 61.

Two contact members 650 are provided at both ends of the roller shaft potion 602 of the secondary transfer roller 61. The contact member 650 has a structure in which a contact surface and the like are provided in an opening area where the concave portion 605 is provided in the secondary transfer roller 61 as seen from the roller shaft direction, and the contact surface comes into contact with a contacted member described more fully below, so that the position between the secondary transfer roller 61 and the belt drive roller 41 is regulated.

Next, a structure for regulating the position between the secondary transfer roller 61 and the belt drive roller 41 while applying a predetermined pressure to the secondary transfer nip of the secondary transfer section 60 comprising the secondary transfer roller 61 in which the concave portion 605 for accommodating the transfer material holding mechanism 610 is provided. FIGS. 3A to 6B are diagrams for explaining the operation of the secondary transfer unit 60 in the image forming apparatus according to the embodiment of the invention. FIGS. 3A, 4A, 5A, and 6A are diagrams of the secondary transfer unit 60 as seen from the side of the apparatus, while FIGS. 3B, 4B, 5B, and 6B are schematic cross-sectional views of the secondary transfer unit 60. FIGS. 3A to 6B show the contact member 650, a rotation support shaft 670, a frame member 671, an urging member 672, a roller shaft portion 689 of the belt drive roller 41, and the contacted member 690. FIG. 7 is a diagram selectively showing a configuration related to the secondary transfer roller 61, the belt drive roller 41, and the like, where the diagram explains a relationship between the contact member 650 and the contacted member 690. FIG. 7 illustrates a first handover surface 661 of the contact member 650, a contact surface 663, and a second handover surface 662.

In the secondary transfer unit 60, the roller shaft potion 602 of the secondary transfer roller 61 is rotatably attached to the frame member 671 at both ends of the roller shaft portion 602. The frame member 671 is rotatable around the rotation support shaft 670, and is urged in the direction of the arrow in FIGS. 3 to 6 by the urging member 672. By such a configuration, the secondary transfer roller 61 is urged toward the belt drive roller 41, and a predetermined pressure can be applied to the secondary transfer nipping area between the secondary transfer roller 61 and the belt drive roller 41. The toner particles on the transfer belt 40 are efficiently transferred onto the transfer material at the secondary transfer nipping area by the transfer pressure and a transfer bias at the secondary transfer nipping area.

Two contact members 650 are provided at both ends of the roller shaft potion 602 of the secondary transfer roller 61. Two contacted members 690 are provided at both ends of the roller shaft potion 689 of the belt drive roller 41 so as to correspond with the two contact members 650. As shown in FIGS. 3B, 4B, 5B, and 6B, the contact member 650 and the contacted member 690 are arranged so that the positions of the contact member 650 and the contacted member 690 in the shaft direction are the same.

The contact member 650 has a shape as shown in FIG. 7, and includes the contact surface 663 which is a distance R3 from the rotation center O of the secondary transfer roller 61, with the first handover surface 661 and the second handover surface 662 provided on both sides of the contact surface 663. The contact surface 663 is provided in an contact area $C_3$ comprising the opening area in which the concave portion 605 is provided in the secondary transfer roller 61 as seen from the roller shaft direction. When the concave portion 605 comes to a position facing the belt drive roller 41 or the transfer belt 40 as the apparatus operates, the contact member 650 comes into contact with the contacted member 690 of the belt drive roller 41 on the contact area $C_3$ of the contact surface 663, so that the urging pressure of the secondary transfer roller 61 is received by the contacted member 690, and the distance and positional relationship between the secondary transfer roller 61 and the belt drive roller 41 are maintained.

As the secondary transfer roller 61 and the belt drive roller 41 rotate, although a constant load state in which a constant load is applied to the secondary transfer nipping area and a constant positional state in which the positional relationship between the secondary transfer roller 61 and the belt drive roller 41 is alternately repeated, the both states can be seamlessly shifted to each other without generating vibration or the like by the area $C_1$ of the first handover surface 661 and the area $C_2$ of the second handover surface 662 provided on both sides of the contact surface 663. As such, there are no adverse effects in the image forming process and image quality deterioration can be prevented. In this embodiment, although the first handover surface 661 (area $C_1$) and the second handover surface 662 (area $C_2$) comprise a tapered surface, a curved surface having a predetermined curvature may also be employed.

The contact member 650 shown in FIG. 7 is a member provided on the shaft portion of the secondary transfer roller 61, and the distance between the circumference of the contact member 650 and the rotation center of the secondary transfer roller 61 varies (the distances from the contact area $C_3$, the area $C_1$, the area $C_2$, and other areas to the rotation center are different from one another), so that the contact member 650 functions as a kind of cam.

The contacted member 690 is a member such as a bearing, and the distance from the rotation center O' of the belt drive roller 41 to the circumference of the contacted member 690 is r. As each roller rotates, the contacted member 690 comes into contact with the contact surface 663 of the contact member 650, and receives the load of the secondary roller 61 urged by the urging member 672, so that the distance and the positional relationship between the secondary transfer roller 61 and the belt drive roller 41 are maintained.

Figures 3A, 3B:
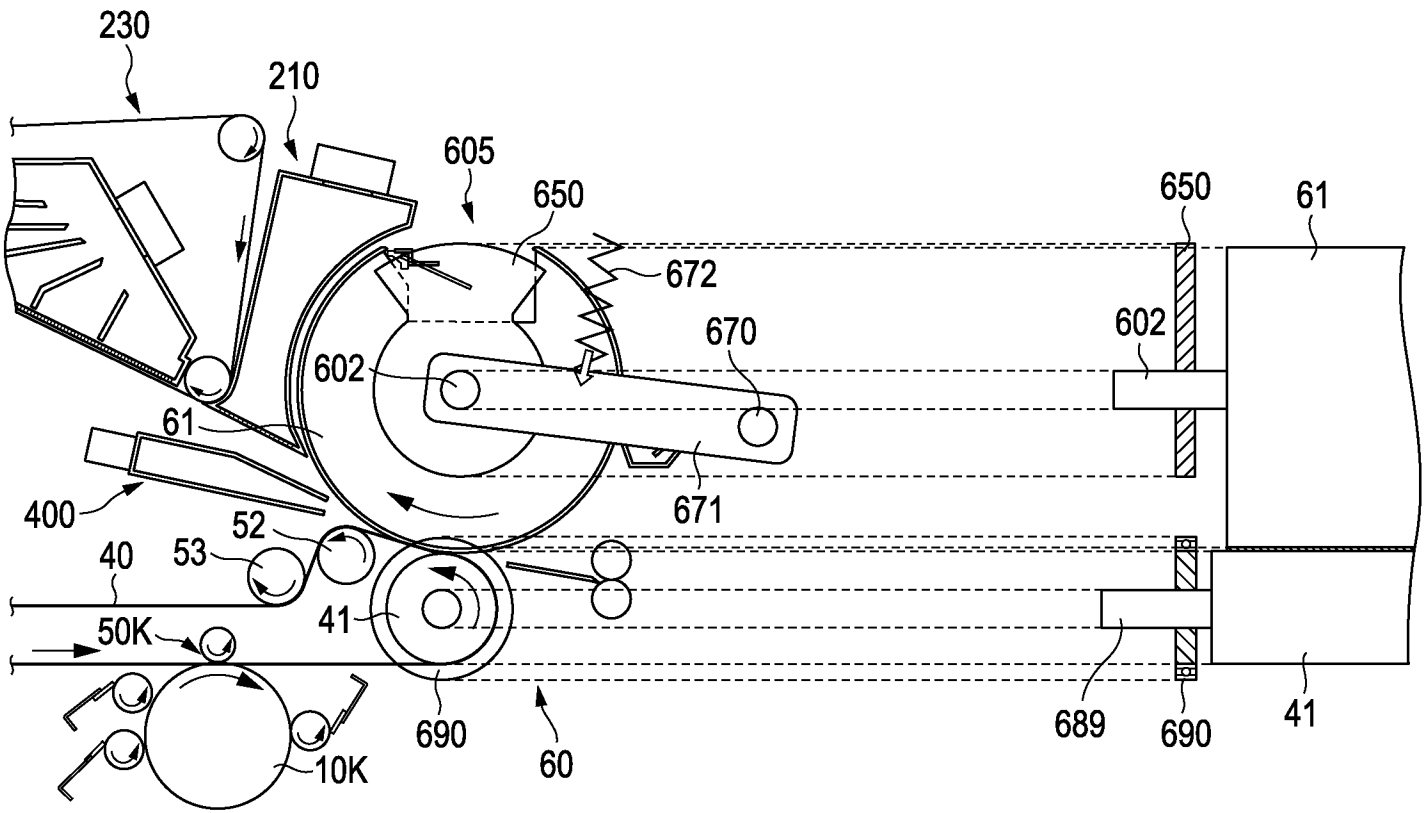
FIGS. 3A and 3B are a diagram for explaining an operation of a secondary transfer unit in the image forming apparatus according to the embodiment of the invention.
Figure 4B:
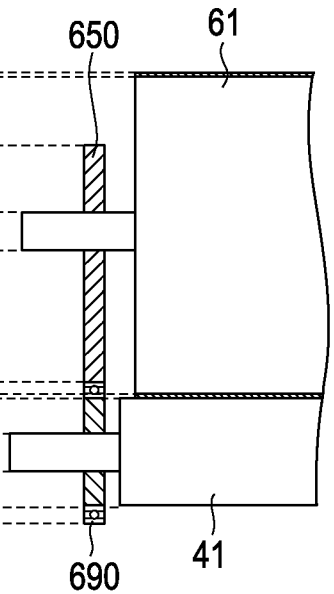
FIGS. 4A and 4B are a diagram for explaining the operation of the secondary transfer unit in the image forming apparatus according to the embodiment of the invention.
Figure 4A:
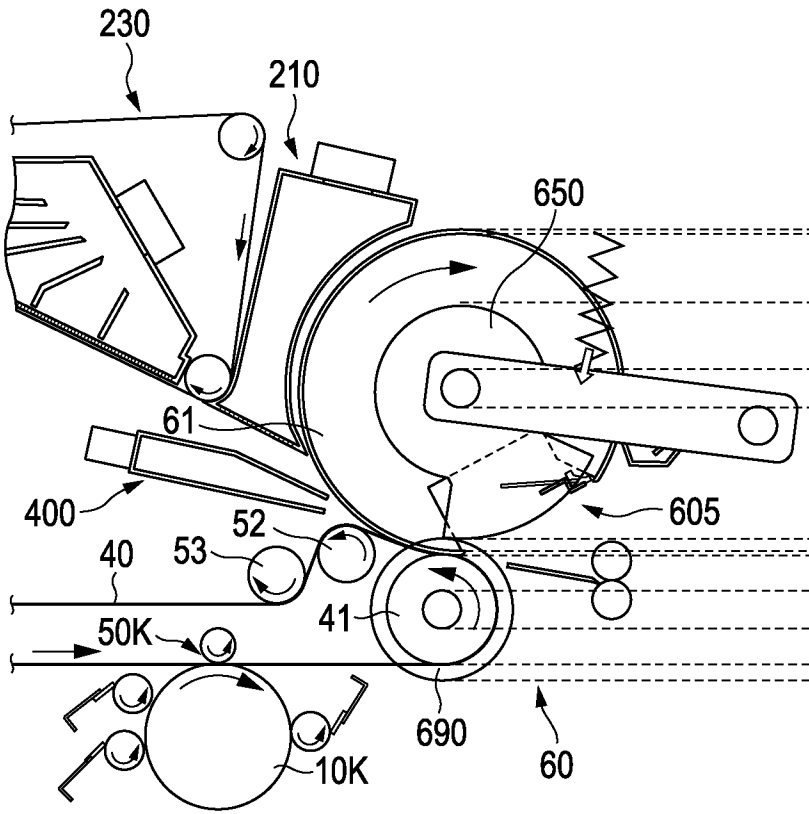
Figures 5A, 5B:
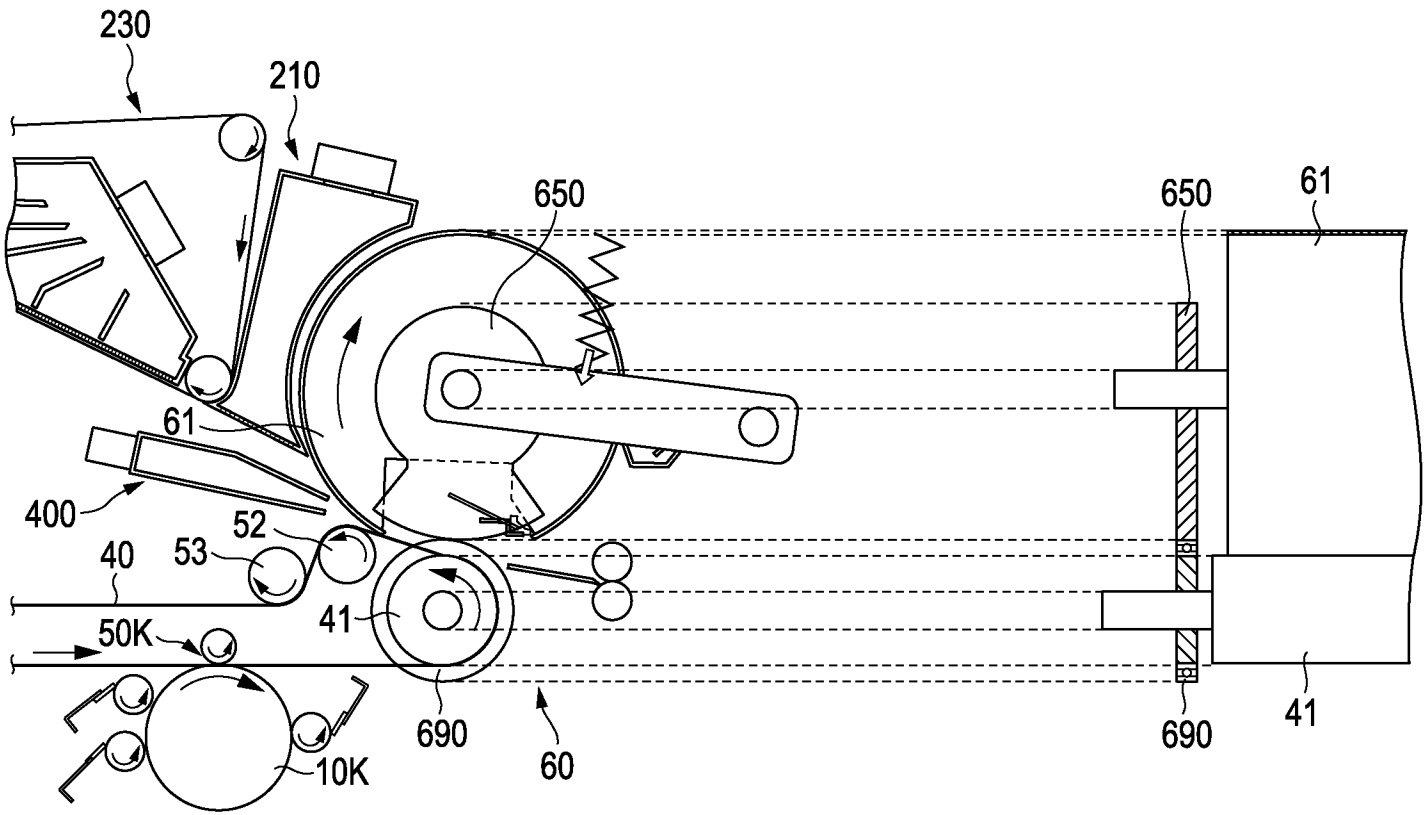
FIGS. 5A and 5B are a diagram for explaining the operation of the secondary transfer unit in the image forming apparatus according to the embodiment of the invention.
Figures 6A, 6B:
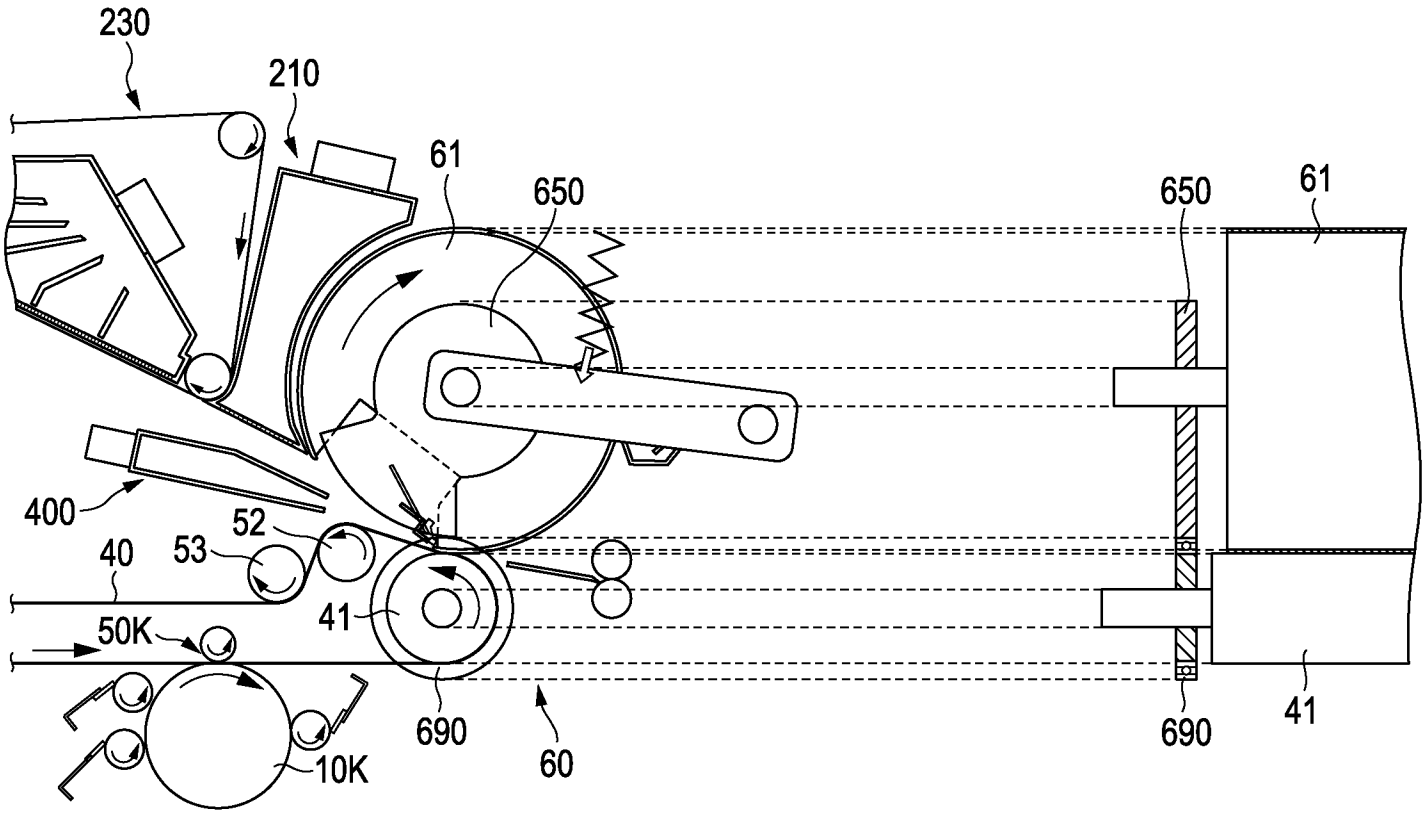
FIGS. 6A and 6B are a diagram for explaining the operation of the secondary transfer unit in the image forming apparatus according to the embodiment of the invention.
Figure 7:
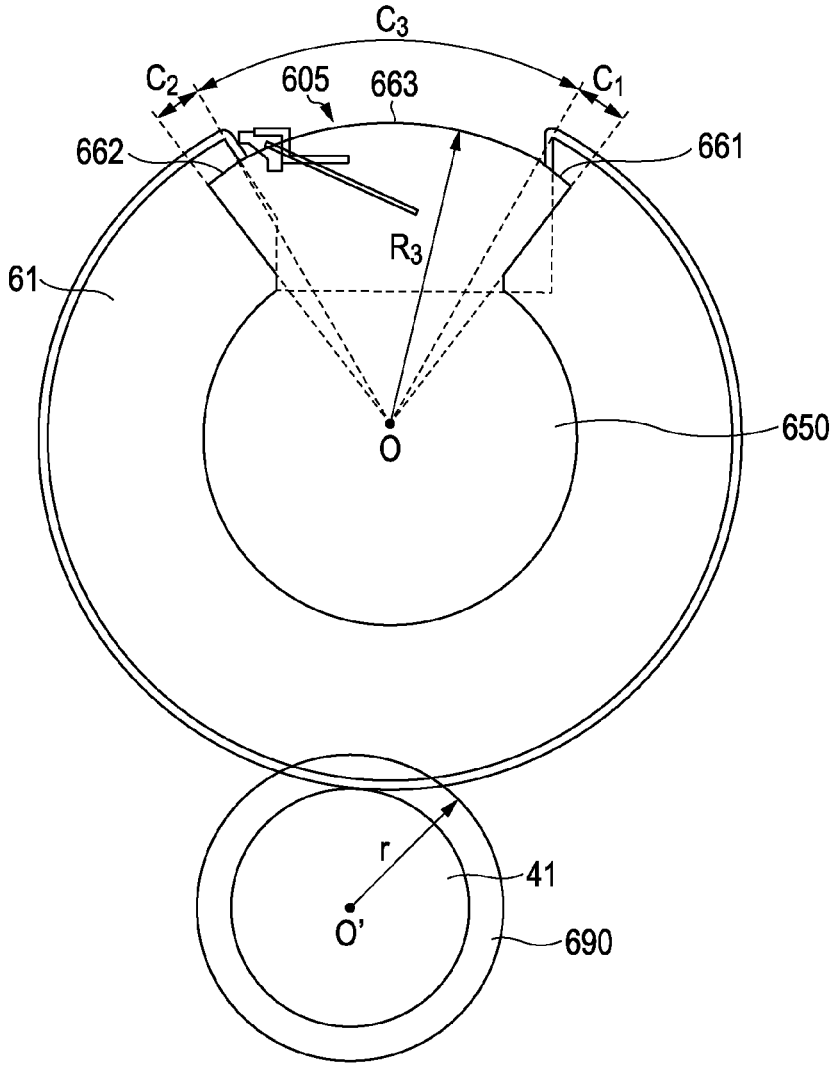
FIG. 7 is a diagram for explaining a relationship between a contact member and a contacted member.

As each roller rotates, the secondary transfer roller 60 operates in sequence from the state shown in FIGS. 3A and 3B, to the state shown in FIGS. 4A and 4B, to the state shown in FIGS. 5A and 5B, to the state shown in FIGS. 6A and 6B, to the state shown in FIGS. 3A and 3B, and so forth. FIG. 3 shows a state in which the concave portion 605 does not face the belt drive roller 41 or the transfer belt 40. At this time, the urging force from the urging member 672 is applied to the second transfer nip, and a predetermined transfer pressure is secured. An appropriate transfer bias is further applied between the secondary transfer roller 61 and the belt drive roller 41, and the toner particles on the transfer belt 40 are transferred onto the transfer material at the secondary transfer nip. In the state shown in FIGS. 3A and 3B, the contact surface 650 and the contacted member 690 are completely separated from each other.

FIGS. 4A and 4B shows a state in which each roller rotates a certain amount and the concave portion 605 approaches but does not reach the belt drive roller 41 or the transfer belt 40. At this time, as each roller rotates, the area $C_1$ of the first handover surface 661 of the contact member 650 gradually approaches the contacted member 690. In other words, the distance between the first handover surface 661 and the contacted member 690 gradually shortens. When each roller further rotates, the contact member 650 and the contacted member 690 come into contact with each other at the boundary between the first handover surface 661 (area $C_1$) and the contact surface 663 (contact area $C_3$), and the load from the secondary transfer roller 61 is received by the contacted member 690, so that the distance and positional relationship between the secondary transfer roller 61 and the belt drive roller 41 are maintained. At the time when the contact member 650 and the contacted member 690 come into contact with each other, the concave portion 605 faces the belt drive roller 41 or the transfer belt 40.

FIGS. 5A and 5B show a state in which each roller further rotate, such that the concave portion 605 completely faces the belt drive roller 41 or the transfer belt 40, and each roller rotates while the contact surface 663 (contact area $C_3$) of the contact member 650 and the contacted member 690 are in contact with each other. At this time, the urging pressure of the secondary transfer roller 61 urged by the urging member 672 is received by the contacted member 690, so that the distance and positional relationship between the secondary transfer roller 61 and the belt drive roller 41 are maintained.

As each roller further rotates, the contact member 650 and the contacted member 690 separate from each other at the boundary between the contact surface 663 (contact area $C_3$) of the contact member 650 and the second handover surface 662 (area $C_2$), and the second handover surface 662 (area $C_2$)

of the contact member 650 and the contacted member 690 gradually move further apart, as shown in FIGS. 6A and 6B. At this time, the concave portion 605 is separated from the belt drive roller 41 or the transfer belt 40, the elastic member 607 of the secondary transfer roller 61 comes into contact with the transfer belt 40, and the urging force from the urging member 672 is applied to the secondary transfer nip. The contact member 650 and the contacted member 690 are separated from each other, and the load from the contact member 650 to the contacted member 690 is also released.

According to the above embodiment, although the secondary transfer roller 61 is urged toward the belt drive roller 41, the contact member 650 is on the shaft portion of the secondary transfer roller 61 and the contacted member 690 is on the shaft portion of the belt drive roller 41, so that, when the concave portion 605 is not in contact with the transfer belt, the secondary transfer roller 61 can apply a predetermined pressure on the transfer nipping area. As such, when the concave portion faces the transfer belt, the positional relationship between the secondary transfer roller 61 and the belt drive roller 41 can be maintained.

According to the above embodiment, even when the secondary transfer roller 61 having the concave portion 605 is used, it is possible to seamlessly move between the constant load state in which a certain amount of pressure is applied to the secondary transfer nip and the constant positional state in which the positional relationship between the secondary transfer roller 61 and the belt drive roller 41 is constant without generating vibration or the like, so that there are no adverse effects in the image forming process and image quality deterioration can be prevented.

Figure 8:
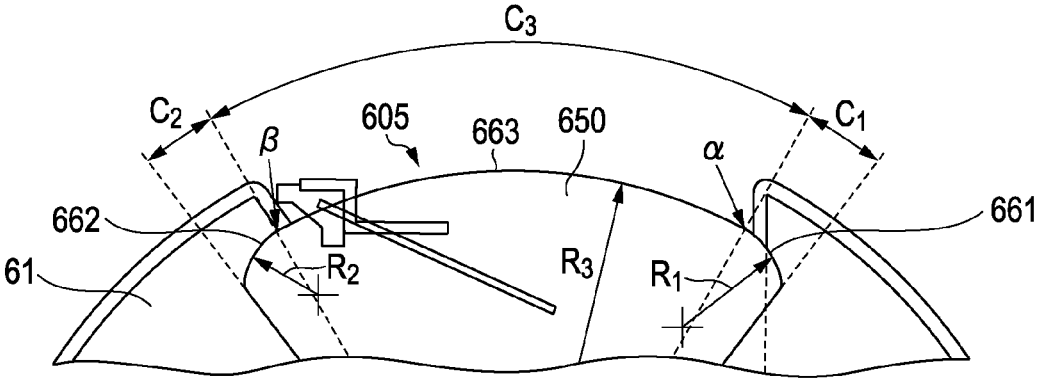
FIG. 8 is a diagram for explaining a shape of a contact member of an image forming apparatus according to another embodiment of the invention.

Next, another embodiment of the invention will be described. FIG. 8 is a diagram for explaining a shape of the contact member of the image forming apparatus according to another embodiment of the invention. In this embodiment, the shapes of the first handover surface 661 and the second handover surface 662 are different from those of the above embodiment, and while other aspects of the configuration are the same as that of the above embodiment.

While in the above embodiment, the first handover surface 661 and the second handover surface 662 are formed by a tapered surface, in this embodiment, the first handover surface 661 (area $C_1$) and the second handover surface 662 (area $C_2$) comprise a curved surface having a predetermined radius R. Here, the first handover surface 661 (area $C_1$) and the second handover surface 662 (area $C_2$) are formed by different curved surfaces having different curvatures. More specifically, the first handover surface 661 (area $C_1$) is formed by a curved surface having a curvature of $R_1$ (centered at the cross shown in FIG. 8) and the second handover surface 662 (area $C_2$) is formed by a curved surface having a curvature of $R_2$ (centered at the other cross shown in FIG. 8). The curvature $R_1$ and the curvature $R_2$ are set to be $R_1>R_2$.

The second handover surface 662 (area $C_2$) having the curvature of $R_2$ is formed on the contact member 650 so that the second handover surface 662 corresponds to the side of the opening edges of the concave portion 605 where the transfer material holding mechanism 610 is provided, and the top margin of the transfer material can be reduced by setting the curvature $R_2$ to be smaller than the curvature $R_1$. Also, transport banding can be reduced by setting the curvature $R_1$ to be larger than the curvature $R_2$.

The contact plane of the first handover surface 661 (area $C_1$) and a contact plane of the contact surface 663 (contact area $C_3$) are configured to share the boundary portion $\alpha$ between the first handover surface 661 (area $C_1$) and the contact surface 663 (contact area $C_3$). Further, a contact plane of the second handover surface 662 (area $C_2$) and the contact plane of the contact surface 663 (contact area $C_3$) are configured to share the boundary portion $\beta$ between the second handover surface 662 (area $C_2$) and the contact surface 663 (contact area $C_3$). By employing this configuration, it is possible to seamlessly move between the constant load state in which a certain amount of pressure is applied to the secondary transfer nip and the constant positional state in which the positional relationship between the secondary transfer roller 61 and the belt drive roller 41 is constant without generating vibration or the like, so that influence on the image forming process can be suppressed and image quality deterioration can be prevented. In this embodiment, the same effects as those of the previously described embodiment can be obtained.

Figure 9:
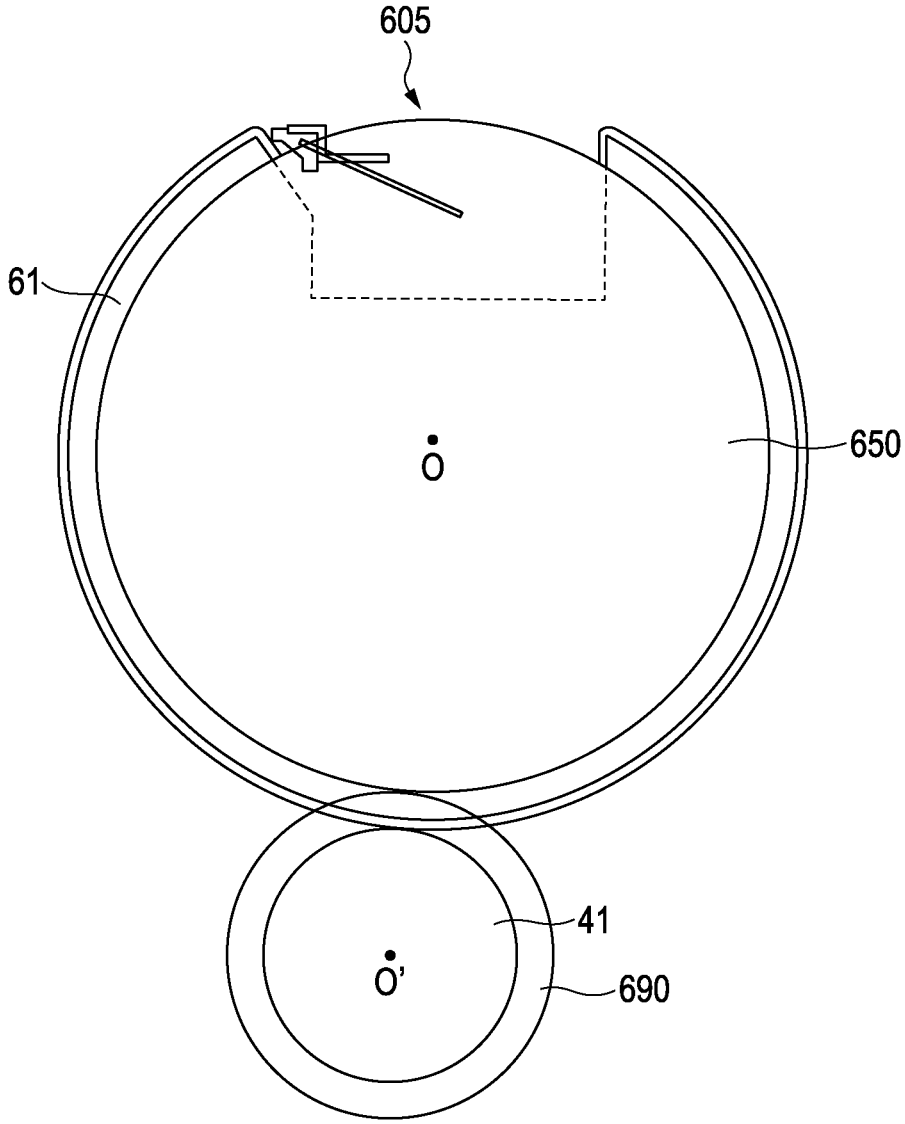
FIG. 9 is a diagram for explaining a contact member and a contacted member of an image forming apparatus according to another embodiment of the invention.
Figures 10A, 10B:
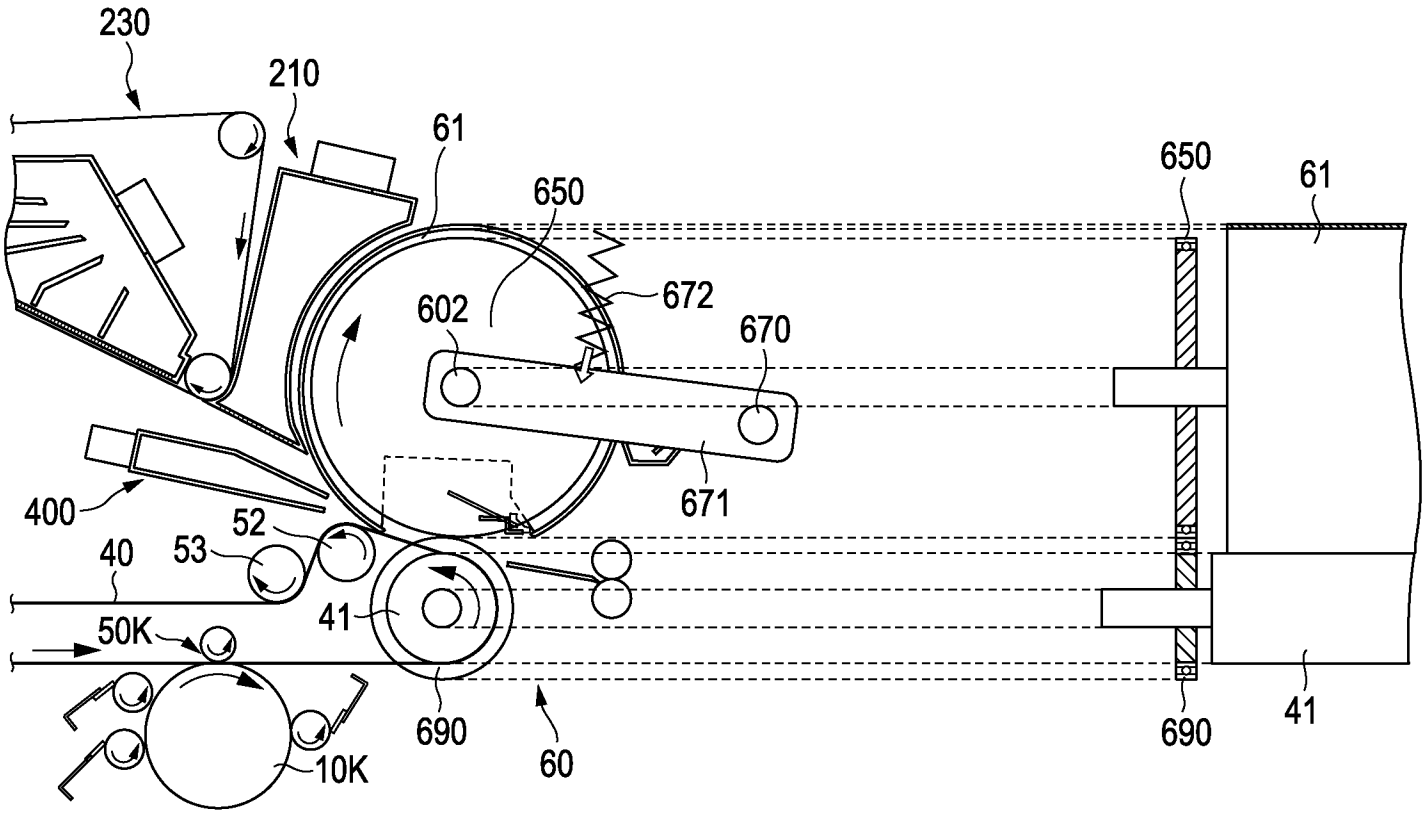
FIGS. 10A and 10B are a diagram for explaining an operation of a secondary transfer unit in an image forming apparatus according to another embodiment of the invention.

Next, another embodiment of the invention will be described. FIGS. 9 and 10A and 10B are diagrams related to an alternative embodiment of the invention. FIG. 9 is a diagram explaining the contact member 650 and the contacted member 690 of the image forming apparatus according to another embodiment of the invention, and FIGS. 10A and 10B is a diagram explaining an operation of the secondary transfer unit 60 of the image forming apparatus according to another embodiment of the invention. FIG. 10A is a diagram of the secondary transfer unit 60 as seen from the side of the apparatus, and FIG. 10B is a schematic cross-sectional view of the secondary transfer unit 60.

The difference between this embodiment and the previously described embodiment is that this embodiment uses a contact member such as a bearing having a circumference with a constant radius from to the rotation center O of the roller to form the contact member 650 provided on the roller shaft portion 602 of the secondary transfer roller 61. In this embodiment, the same effects as those of the previously described embodiment can be obtained, and at the same time, a general purpose component such as a bearing can be used as the contact member 650, so that an effect that the apparatus can be manufactured at a lower cost can be obtained.

Figure 11:
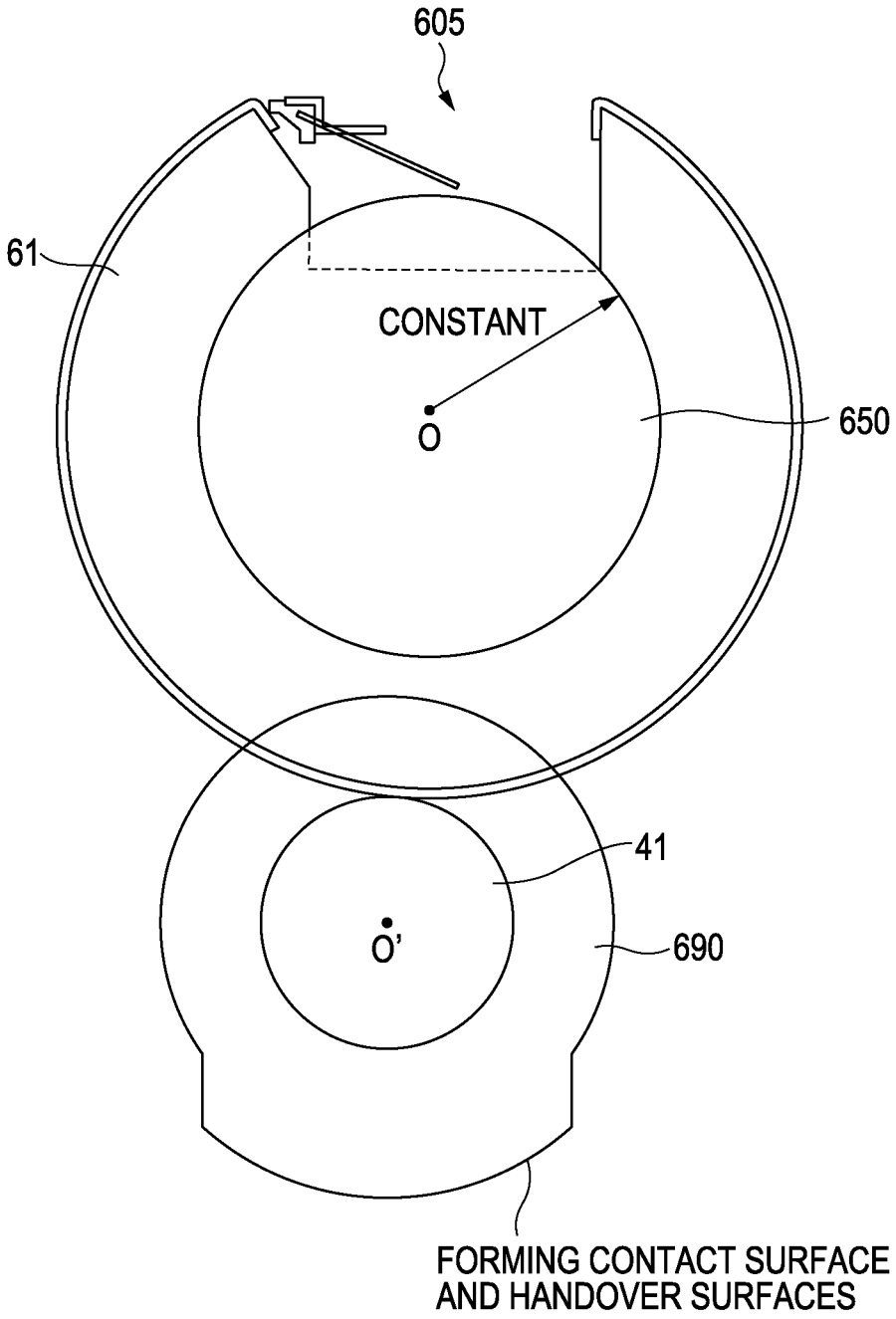
FIG. 11 is a diagram for explaining a contact member and a contacted member of an image forming apparatus according to another embodiment of the invention.

Next, another embodiment of the invention will be described. FIG. 11 is a diagram for explaining the contact member 650 and the contacted member 690 of the image forming apparatus according to still another embodiment of the invention. FIG. 11 is a diagram selectively showing a configuration related to the secondary transfer roller 61, the belt drive roller 41, and the like. In the embodiment shown in FIG. 11, a member such as a bearing having a circumference with a constant radius to the rotation center O of the secondary transfer roller 61 is used as the contact member 650, while a member in which the contact surface, the first handover surface, and the second handover surface are formed is used as the contacted member 690. By using such a contact member 650 and a contacted member 690, the same effects as those of the previously described embodiment can be obtained.

As may be understood by one of ordinary skill in the art, the embodiments described herein are exemplary only and other embodiments may be used without departing from the meaning and scope of the invention.

What is claimed is:

1. An image forming apparatus comprising:

a transfer belt on which an image is transferred;

a belt suspension roller that stores the transfer belt;

a transfer roller that is arranged so as to face the belt suspension roller with the transfer belt disposed in between, the transfer roller including a shaft portion and a concave portion formed in a shaft direction; and a support member that is arranged on the shaft portion of the transfer roller and includes a first circumferential portion arranged in the concave portion of the transfer roller as seen from a shaft direction of the transfer roller, a second circumferential portion arranged at one side of the concave portion in a rotation direction of the transfer roller as seen from the shaft direction of the transfer roller, and a third circumferential portion arranged at the other side of the concave portion from the one side in the rotation direction of the transfer roller as seen from the shaft direction of the transfer roller.

2. The image forming apparatus according to claim 1, wherein the second circumferential portion has a first curvature and the third circumference portion has a second curvature different from the first curvature.

3. The image forming apparatus according to claim 1, further comprising:

a transfer material holding section that holds a transfer material, the transfer material holding section being arranged on the side of the third circumferential portion of the concave portion of the transfer roller, wherein a first curvature is set to be larger than a second curvature.

4. The image forming apparatus according to claim 1, wherein a virtual contact plane of the first circumferential portion and a virtual contact plane of the second circumferential portion share a common area at a boundary portion between the first circumference portion and the second circumference portion.

5. The image forming apparatus according to claim 1, wherein a virtual contact plane of the first circumferential portion and a virtual contact plane of the third circumferential portion share a common area at a boundary portion between the first circumferential portion and the third circumferential portion.

6. The image forming apparatus according to claim 1, further comprising:

a second support member that comes into contact with the support member at a shaft end portion of the belt suspension roller, wherein the first circumferential portion of the support member and the second support member come into contact with each other.

7. An image forming method comprising:

carrying an image on a transfer belt suspended by a belt suspension roller;

transferring the image to a transfer material by passing the transfer material through a transfer nipping area formed by causing a transfer roller having a concave portion formed in a shaft direction to come into contact with the belt suspension roller with the transfer belt in between; and after transferring the image to the transfer material, causing a support member that is arranged on a shaft portion of the transfer roller and includes a first circumferential portion arranged in the concave portion of the transfer roller as seen from a shaft direction of the transfer roller, a second circumferential portion arranged at one side of the concave portion in a rotation direction of the transfer roller as seen from the shaft direction of the transfer roller, and a third circumferential portion arranged at the other side of the concave portion from the one side in the rotation direction of the transfer roller as seen from the shaft direction of the transfer roller to come into contact with a second support member arranged at a shaft end portion of the belt suspension roller.

8. An image forming apparatus comprising:

a transfer belt on which an image is transferred;

a belt suspension roller that stores the transfer belt;

a transfer roller that is arranged so as to face the belt suspension roller with the transfer belt disposed in between, the transfer roller including a shaft portion and a concave portion formed in a shaft direction;

a support member that is arranged on the shaft portion of the transfer roller and includes a first circumferential portion arranged in the concave portion of the transfer roller as seen from a shaft direction of the transfer roller, a second circumferential portion arranged at one side of the concave portion in a rotation direction of the transfer roller as seen from the shaft direction of the transfer roller, and a third circumferential portion arranged at the other side of the concave portion from the one side in the rotation direction of the transfer roller as seen from the shaft direction of the transfer roller; and a transfer material holding section that holds a transfer material, the transfer material holding section being arranged on the side of the third circumferential portion of the concave portion of the transfer roller, wherein the second circumferential portion has a first curvature and the third circumferential portion has a second curvature different from the first curvature, and wherein the first curvature is set to be larger than the second curvature.

* * * * *